United States Patent [19]

Mikotin et al.

[11] 4,103,734

[45] Aug. 1, 1978

[54] COUNTERPRESSURE CASTING ARRANGEMENT

[76] Inventors: Evgeny Emelyanovich Mikotin, ulitsa Tereshkovoi, 8a, kv. 61, Odessa; Mikhail Konstantinovich Trifsik, ulitsa Nikolaeva, 21a, kv. 8, Smolensk; Igor Stepanovich Vavilov, ulitsa Chkalova, 119, kv. 11, Odessa; Jury Danilovich Mangubi, ulitsa Krasnogvardeiskaya, 13, kv. 47, Smolensk; Boris Andreevich Timofeev, ulitsa B. Khmelnitskogo, 36, kv. 44, Odessa; Anatoly Filippovich Timofeev, ulitsa Tvardovskogo, 8, kv. 9, Smolensk; Yakov Mikhailovich Ryvkis, ulitsa Garibaldi, 14, kv. 26, Odessa; Mark Moiseevich Aizenkaid, ulitsa Lomonosova, 1/74, kv. 39, Smolensk; Nikolai Vasilievich Samusenkov, ulitsa Leningradskaya, 1, kv. 3, Odessa; Alexandr Ivanovich Ermolaev, ulitsa Lenina, 75b, kv. 38, Chernigov; Anatoly Andreevich Zuev, Tiraspolskoe shosse, 21, kv. 121, Odessa; Vladimir Alexandrovich Antonov, ulitsa Karla Libknekhta, 142, kv. 11, Tiraspol; Evgeny Efremovich Kosogov, ulitsa Dyatkovskaya, 32, Bryansk; Stanislav Andreevich Aldakushin, ulitsa Dekhoti, 23/17, kv. 76, Dushanbe; Viktor Gavrilovich Yanin, ulitsa Perekopskoi divizii, 12/7, kv. 10, Odessa; Vitaly Ivanovich Mazurik, prospekt Shevchenko, 6, korpus 1, kv. 6, Odessa; Ivan Nikiforovich Teslya, ulitsa Chkalova, 40, kv. 16, Odessa; Savely Leonidovich Burakov, Treugolny pereulok, 13, kv. 23, Odessa; Petr Petrovich Soloviev, ulitsa Nikolaeva, 42, kv. 59, Smolensk; Rostislav Lukyanovich Snezhnoi, ulitsa Bogdana Khmelnitskogo, 34/36, kv. 42, Odessa, all of U.S.S.R.

[21] Appl. No.: 796,079

[22] Filed: May 12, 1977

[51] Int. Cl.[2] ..... B22D 27/10

[52] U.S. Cl. ..... 164/309; 164/341; 164/344

[58] Field of Search ..... 164/309, 337, 339, 341, 164/344, 136, 306

[56] References Cited

U.S. PATENT DOCUMENTS

| | | | |
|---|---|---|---|
| 2,270,340 | 1/1942 | Pritchard | 164/309 |
| 3,450,190 | 6/1969 | Mittermaier et al. | 164/309 |
| 3,701,377 | 10/1972 | Fisher | 164/309 X |
| 3,757,850 | 9/1973 | Diez et al. | 164/309 |
| 3,804,152 | 4/1974 | Cook et al. | 164/309 X |

*Primary Examiner*—Robert L. Spicer, Jr.
*Attorney, Agent, or Firm*—Lackenbach, Lilling & Siegel

[57] ABSTRACT

The present invention relates to counterpressure casting arrangements and may prove to be most advantageous for producing castings which should meet more exacting requirements as to their physicomechanical properties and tightness.

Said arrangement comprises a pouring device with a partition plate subdividing it into two chambers, of which the bottom one contains a vessel for the melt, while the top one accommodates a casting die, the arrangement having also a die-casting machine located outside the body of the top chamber and provided with a device for reiterated introduction and withdrawal of the dies, said device being mounted on a transporting device which is made with a possibility of carrying the dies from the die-casting machine to the partition plate of the pouring device and back to said machine.

11 Claims, 15 Drawing Figures

COUNTERPRESSURE CASTING ARRANGEMENT

The present invention relates to equipment for producing castings in dies under a gas pressure and more particularly to counterpressure casting arrangements.

The present invention may prove to be most advantageous for producing castings which should meet in service more exacting requirements as to their physicomechanical properties and tightness, such as, high-pressure pump bodies or internal-combustion engine cylinder heads.

At present the low-pressure die casting technique has found wide application, said technique consisting essentially in that a casting die under atmospheric pressure is filled with liquid metal fed into said die under a surplus gas pressure; thus, for casting aluminum alloys said pressure amounts to about 0.2–0.8 kgf/cm$^2$, the casting being fed additionally with the melt supplied froma a pouring vessel during its solidification.

As compared with the casting methods based on filling the dies under the effect of a gravitational pressure of a melt column, said low-pressure die casting technique makes it possible to actually obviate both casting risers and gates, a feature increasing the utilization of the melt up to 93–98% and providing a 10–20% improvement of the physicomechanical properties of the castings.

Low-pressure die-casting arrangements are made as a sealed furnace with a crucible for the melt and a pipe immersed in said melt, both of them being contained in the furnace body, the upper end of said pipe being fixed in a furnace cover. Said furnace cover mounts a casting die so that its runner, arranged in the bottom portion of the die, is in register with the pipe passage submerged into the melt. A device for assembly and disassembly of the split casting die and that for removing the casting from the die are also set up on the furnace cover. On assembly of the die an excess air pressure of about 0.2–0.8 kgf/cm$^2$ is built-up in the furnace; under the effect of said pressure the melt fills the die and upon solidifying of the casting the excess pressure in the furnace is reduced to atmospheric one, whereby the surplus liquid metal flows from the pipe into the crucible.

Next the die is dismantled, the casting is removed therefrom, whereupon the die is re-assembled and the casting cycle is repeated. During the low-pressure die-casting process the die, both when its cavity is being filled with the melt and during solidification of the casting is under atmospheric pressure.

However, on some occasions the low-pressure die-casting technique fails to produce the castings featuring the required strength and tightness, insofar as it is impossible to avoid porosity and coarse-crystallite structure stemming mainly from the castings solidifying under atmospheric pressure.

The above undesirable phenomena can be eliminated by resorting to the counterpressure casting technique which essentially consists in that when filling the die with liquid metal and during solidification of the casting both the melt and the die are exposed to the effect of an all-round excess gas pressure which, e.g., for aluminum alloys amounts to about 6–10 kgf/cm$^2$, and the supply of the liquid metal into the die, as well as the feeding of the casting with said liquid metal during its solidifying are effected by providing a difference in the gas pressure within the die and in the pouring vessel. In this case said pressure difference is of the same order as that obtainable during low-pressure die casting.

Counterpressure casting arrangements comprise a pouring device with a partition plate subdividing it into two chambers, the body of the bottom of said chambers accommodating a vessel for the melt and a pipe interconnecting said vessel and a split casting die disposed in the body of the top sealed chamber, said pipe being mounted movably together with the partition plate with respect to the body of the bottom chamber, said arrangement comprising also a device for assembly and disassembly of the die and that for removing the castings from said die, the last two devices being located on the body of the top sealed chamber and made movable together with said body but only in a vertical direction. The casting die has one main horizontal parting line and is built-up of two parts, of which the bottom one is fixed stationary on the partition plate, while the top one can move jointly with the body of the top sealed chamber.

When casting under counterpressure on said arrangements the structure of the castings is substantially improved, porosity is practically avoided, the casting solidifying time is cut down, its surface finish is improved and burning-on of the sand members of the die to the casting is decreased, insofar as the melt, when filling the die and during the solidification of the casting, is subjected to an excess gas pressure.

Owing to the above-specified peculiarities of moulding the casting material during the counterpressure casting process said process provides a 20–35% enhancement of physicomechanical properties of the castings, as compared with the low-pressure die casting technique, along with a several-fold increase in tightness of cast parts. Moreover, said method allows producing castings from materials dissociable and decomposable on being melted under atmospheric pressure, and making castings saturated intentionally with certain gas constituents, this being not feasible in low-pressure die casting.

However, when casting under counterpressure on prior-art arrangements only one die is employed for casting purposes, this diminishing the efficiency of said arrangements.

Moreover, as the devices for assembly, disassembly and removal of the castings from the die are disposed on the body of the sealed chamber, the die can be disassembled by carrying vertically only its top portion, this determining the use of the dies with only one main horizontal parting line, which in turn results in that the prior-art arrangements are applicable only for producing castings of a simple geometry. As is known, intricate castings can be produced only in the dies built-up of more than two parts with joints running in various planes. However, the application of said dies on the prior-art arrangements is impossible, since said arrangements do not comprise devices for splitting the die members in several planes.

The production of large-size castings on the known arrangements presents also a problem, since it necessitates the use of cumbersome gears for disassembly, assembly and removal of the castings, said gears being disposed on the body of the top sealed chamber. This in turn will require the body of greater dimensions and a considerably more sophisticated locking device ensuring its tightness.

The main object of the present invention is to provide a counterpressure casting arrangement which by combining in time such operations as the filling of one of dies and disassembly and removal of a casting and assembly of the other die, and owing to a new layout of devices for assembly and disassembly of said dies and for the removal of the castings therefrom will feature a higher production rate and allow using multiple part dies composed of more than two parts and having a plurality of joints running in various planes, including the dies for producing large-size castings.

Said object is achieved by that in a counterpressure casting arrangement, comprising a pouring device with a partition plate subdividing it into two chambers, with a body of the bottom chamber accommodating a vessel for the melt and a pipe interconnecting said vessel and a split die contained in the body of the top sealed chamber, said pipe being arranged movably together with the partition plate with respect to the body of the bottom chamber, said arrangement comprising also a device for assembly and disassembly of the die and a device for removing castings therefrom, according to the invention, as the device for assembly and disassembly of the die and that for removing the castings therefrom use is made of a die-casting machine provided with a device for reiterated introduction and withdrawal of the die, said device being mounted on a transporting device that is provided with a possibility of carrying the die from said die-casting machine to the partition plate of the pouring device and back to the machine, the body of the top sealed chamber being made revolvable about a stationary spindle to transfer said transporting device with the die.

Said embodiment of the proposed arrangement offers a high production rate, insofar as in service two casting dies are employed concurrently during one technological cycle ensuring the moulding of a casting in one of said dies and the removal of the casting and servicing of the other die, all these operations being effected at the same time. Moreover, the proposed arrangement allows using casting dies, each of said dies being adapted for producing castings differing in their geometry, size and weight.

As the devices for assembly and disassembly of the dies and for the removal of the castings are located outside the body of the top sealed chamber, the design of the pouring devices is greatly simplified; it also provides better conditions for low-pressure die casting therein, cuts down metal requirements and overall dimensions of said device and enhances its functional reliability.

Insofar as the devices for assembly and disassembly of the die and for the removal of the castings are made as the die-casting machine, it permits casting into multiple-part dies composed of more than two parts and having a plurality of combination joints. Therefore the proposed arrangement can be utilized for producing castings with sophisticated geometry, larger both in size and weight and unobtainable heretofore on prior-art counterpressure casting arrangements, i.e. the casting and technological potentialities of the counterpressure casting arrangements are thus broadened considerably.

A possibility of mounting and removing the casting die from the die-casting machine during each casting cycle is provided by fitting said machine with the device for reiterated introduction into and withdrawal of the dies from said machine, while the presence of the transporting device makes it possible to handle the casting dies from the pouring device to the die-casting machine and back during the casting process, both dies being handled simultaneously and independently from each other.

The use of the turnable body of the top sealed chamber of the pouring device provides free access for the transporting device carrying the die to the partition plate; it also improves the servicing of the bottom body of the pouring devices and of the pipe, simplifying substantially the filling of the vessel with the melt.

According to the invention, the devices for reiterated introduction and withdrawal of the die of the die-casting machine comprises a die registering gear which is made as spring-biased stops arranged in the grooves of die plates of the die-casting machine, said stops being made with a possibility of interacting with the die elements, and a die gripping gear arranged on a base plate fitted with a movable crossbar, said gear being made as driven articulated levers with tracing grooves accommodating rollers set up in brackets of said crossbar, said levers being made so as to interact with the bottom die part.

The presence of the casting die registering gear in said die-casting machine makes it possible to avoid the misalignment of the casting die when mounting it on the base plate to be in register with the die plate grooves and when handling it back; it also allows, upon assembling the die on a machine, to force the die plate from the corresponding parts of the die by a definite value to provide an all-round clearance between the plate grooves and die parts and thereby to release the die for withdrawing it from the die-casting machine.

The presence of the die gripping gear set up on the base plate of the die-casting machine ensures a rigid connection between the bottom die part and the base plate, this being effected with the help of driven levers of said gear and being required to assemble and disassemble the side and end face die parts. While effecting said operations the stationary base plate acts as a guide member of said die parts. Moreover, the presence on the base plate of the die gripping gear enables the casting to be ejected from the bottom die part which remains stationary during said ejection, the pushers contained therein interacting, on being transferred, with the casting. Said embodiment of the die gripping gear mounted on the base plate ensures its small overall dimensions and high functional dependability.

According to the invention, the base plate of the die-casting machine is fitted with a gear for removing the castings from the bottom die part, said gear being made as sleeves arranged on a movable crossbar, the bases of said sleeves mounting collar-ended pins, said pins being set up on resilient members and said sleeves and pins being made so that when removing the castings the sleeves are capable of interacting with the pushers in the bottom die part, said pushers being made hollow so that the pins are free to enter them (said pushers) and when the pushers of the bottom die part return to their initial position the collars of the pin end faces can interact with balls mounted in the pushers and capable of running thereinto.

The use of the casting pushing gear arranged also on the base plate of the die-casting machine extends substantially the casting and technological potentialities of the proposed arrangement, since it can be employed for producing castings which, upon stripping the die, remain in the bottom die part; it also simplifies the severing of the top die part if the casting, upon dismantling the die, remains in its top part.

Owing to the above embodiment of said gear the die pushers can be reliably registered with the sleeve pins, this being necessary to remove the castings from the bottom die part.

Owing to the collars provided at the ends of said pins and interacting with the pusher balls, the pushers of the bottom die part, when returning the sleeves, can be returned upon removing the castings therefrom, providing therefore a possibility of releasing the bottom die part from the machine casting removing gear to enable the subsequent hoisting of the assembled die from the base plate of the die-casting machine.

To simplify the design of said base plate, to decrease its overall dimensions and to release its area for arranging the die gripping gear and that for removing the castings from the bottom die part thereon, said gears, according to the invention, are provided with a common drive which is made as a power cylinder set up on the base plate and having two movable members, one of which, autonomous, is mounted so as to interact, while gripping the die on the base plate, with the second movable member that is linked mechanically with the movable crossbar.

The above-outlined embodiment of the drive results in a saving in the consumption of a working agent and enhances the drive reliability by decreasing the number of its packing members.

In the arrangement, according to the invention, the die plates of the die casting machine are fitted with drives with axially-movable bars made so as to interact with the die parts and provided with gears for fastening said die parts into a single die, said gears being made as grooved spring-biased and movable axially pins and articulated double-arm levers, with one arm of each of said levers being disposed in the groove of an appropriate pin and having a possibility of interacting with said pin, while the other arm of each lever can interact with said bars.

Owing to the presence of the axially-movable bars on the die plates of the die-casting machine the die parts, upon mounting the die on the base plate and on being gripped thereon, can be unfasten, this being necessary for subsequent disassembly of the die when the machine die plates start moving. The use of the die fastening gears for obtaining a single die makes it possible to fix its parts rigidly and to provide concurrent gripping of all said parts to hoist them from the die-casting machine and to handle the fastened die to the partition plate of the pouring device and back to the machine, this being effected by the transporting device. Moreover, the presence of said gears precludes undesirable mutual engagement of the die elements during said operations. The proposed embodiments of said gears for fastening the die parts ensures their high functional dependability and reduces overall dimensions of the die.

According to the present invention, the transporting device is made as brackets mounted rotatably on a common column, each bracket being provided with an individual rotary drive disposed on the top base of said bracket, with the device for the introduction and withdrawal of the dies of the die-casting machine being cantilevered on each of said brackets. Owing to the above arrangement of the brackets of said transporting device on the common column, the overall dimensions of said device can be decreased; it also allows offsetting partly the bending moments acting on said column and created by the brackets arranged on the opposite sides and, hence, reducing the column metal requirements.

Since the brackets are provided with individual drives, they (said brackets) can operate independently from each other, with one of said brackets being set to an intermediate position, while the other one is operatively associated with the die-casting machine or with the pouring device. Moreover, the presence of individual drives allows providing each of them with mechanical and electrical interlocks precluding the collision of said brackets, a feature that enhances functional reliability of the transporting device of the proposed arrangement.

According to the invention, the individual bracket rotary drive is made as a toothed rack fixed on said bracket and interacting with a gear arranged on the common column, said rack having a possibility of reciprocating to turn the brackets in opposite directions.

The inherent design of said individual rotary drives of the transporting device brackets permits simplifying the construction, reducing the weight and overall dimensions of said drives and ensuring their reliable operation when turning the brackets in opposite directions. Moreover, the above embodiment of said bracket rotary gear enables smooth decrease of an angular speed of rotation of the brckets as they approach either the die-casting machine or the pouring device. Said decrease in the rotary speed when approaching either the die-casting machine or the pouring device is required for accurate stopping and registering of the die attitute to enable their accurate positioning in the grooves of the die plates and on the partition plate.

Said device for reiterated introduction and withdrawal of the die, according to the invention, is a power cylinder whose connecting rod with a piston is cantilevered on the bracket and a cylinder liner is mounted movably in a vertical plane and carries a power plate and a gear for removing the castings from the top die part; said gear being furnished with a pusher crossbar and the power plate being provided with a gear for gripping and keeping the die on the transporting device and the bracket being fitted with guides for the cylinder liner whose bottom end acts as a guide for the pusher crossbar. In view of the above embodiment it is possible to effect a strictly oriented spatially transfer of the power plate, pusher cross-bar and of the gear for gripping and keeping the dies by means of one power cylinder and in a prescribed sequence of operations.

According to the invention, said gear for gripping and keeping the dies on the transporting device is made as four driven double-arm levers, with one arm of each lever being able to interact with the die and with the power plate mounting lock rods, fastened thereto and interacting with the gripped die while removing the casting from the top die part. Said embodiment enables the die to be reliably secured to the device for its introduction and withdrawal and to its transporting device when handling it (the die) from the die-casting machine to the pouring device and back to said machine. Moreover, when removing the casting from the top die part it allows limiting the ejection forces to the power plate by means of the lock rods and relieving the power cylinder liner, the brackets and the column of the transporting device from said forces.

The novelty of the invention resides in that the body of the top sealed chamber of the pouring device is furnished with a gear for locking the die parts on the partition plate, said gear being made as double-arm driven levers, with one arm of each lever interacting with the die, said levers being actuated by a drive made as a bellows with a connecting rod, the internal space of said bellows communicating with the top sealed chamber and the bellows rod being provided with a limiting collar and interacting with the second arm of each of said levers.

The presence of said gears allows decreasing the clearances between the die parts and obviating mutual shifting of its parts under the effect of dynamic forces of the melt flow; it permits also producing more precise castings owing to exact geometric dimensions of the die cavity which do not change when it is being filled with liquid metal and during the solidifying of the casting therein.

The herein-proposed embodiment of said gear which is made as the bellows with the internal space connected to the top chamber enables the use as a working agent of said gear drive of a gas fed for effecting the process into the top chamber; it also affords the possibility of reducing the number of pneumatic lines and packing elements and enhancing the reliability of said gear.

According to the invention, the partition plate is mounted rotatably in a vertical plane about a stationary spindle that is in register with the pivotal axis of the top sealed chamber body, the plate being fitted with a gear adapted to connect it alternatingly to the bodies of either the top or bottom sealed chambers. This provides better servicing conditions for both the furnace and the pipe for feeding the melt into the die.

The nature of the invention will be clear from the following detailed description of its particular embodiment thereof, to be has in conjunction with the accompanying drawings, in which:

FIG. 1 is a general front view of the proposed counterpressure casting arrangement;

FIG. 2 - ditto, a top view;

FIG. 3 - ditto as in FIG. 2 without a gear for reiterated introduction and withdrawal of a die;

Figure 1:
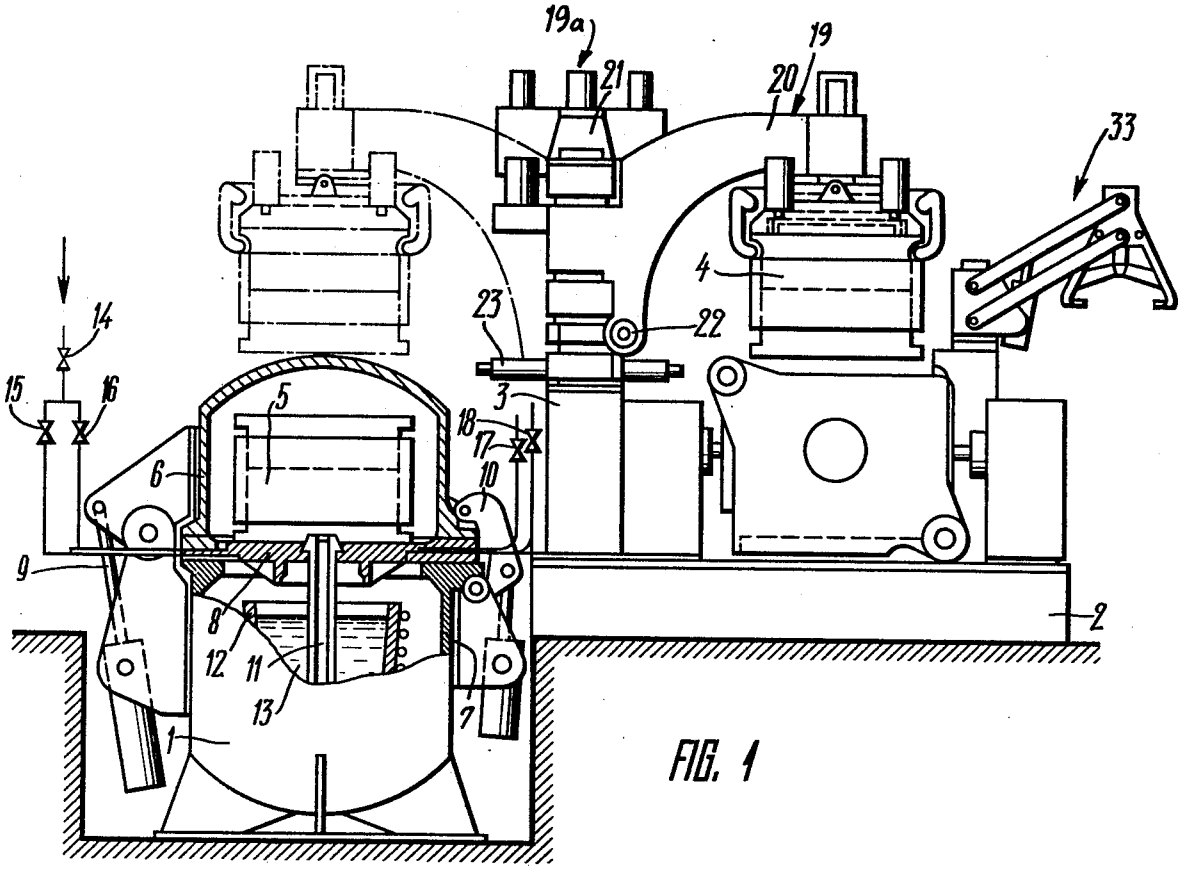

The herein-proposed arrangement comprises a pouring device 1 (FIGS. 1, 2), a die-casting machine 2, a transporting device 3 and two dies 4 and 5. The pouring device 1 comprises a body 6 of the top sealed chamber, a body 7 of the bottom chamber, a horizontal partition plate 8, a gear 9 for turning the body 6 of the top chamber and a gear 10 for locking the pouring device 1.

Fastened to the partition plate 8 is a pipe 11 interconnecting a vessel for melt 13, said vessel being arranged in the bottom body 7, and the die 4 (or 5) mounted on the plate 8 under the body 6 of the top chamber.

The arrangement is provided with a compressor plant which supplies gas under pressure through a pneumatic system and valves 14, 15 and 16 into the pouring device 1 and is adapted to bleed the gas from the top and bottom chambers of said pouring device 1 through valves 17 and 18.

The die-casting machine 2 is furnished with two devices 19 and **19*a* for the reiterated introduction and withdrawal of the die, said devices 19 and 19*a* being disposed on appropriate brackets 20 and 21 of the transporting device 3, said brackets 20 and 21 being fitted with individual drives 22 and 23 and the transporting device being adapted for carrying the die 4 or 5 from the pouring device 1 to the die-casting machine 2 and back to the device 1**.

Figure 3:
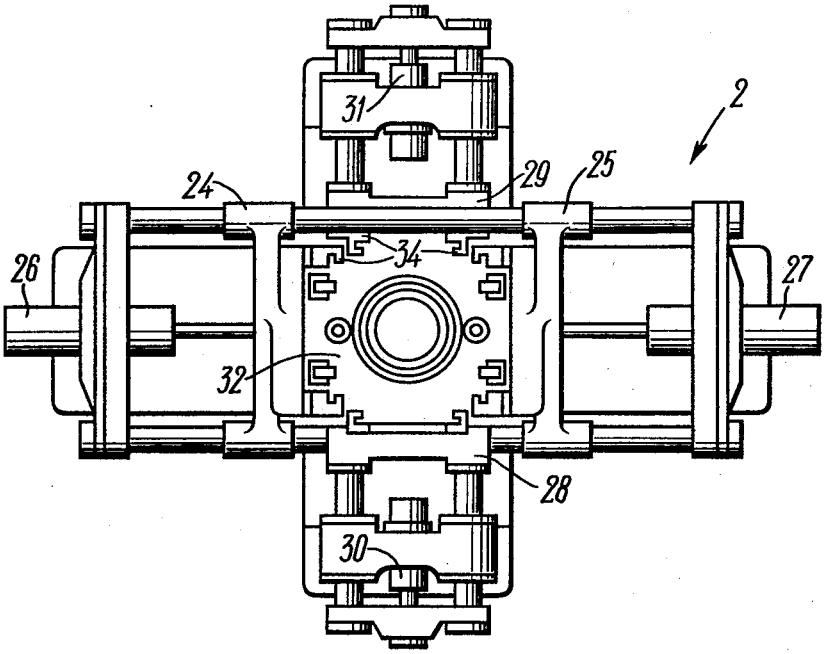

The die-casting machine 2 (FIG. 3) has side die plates 24 and 25 with drives 26 and 27 and end face die plates 28 and 29 with drives 30, 31, said end face die plates acting as devices for assembling and disassembling of the dies. Moreover, the die-casting machine comprises a base plate 32 which acts as a device for removing the castings from the bottom die part; provision is also made for a gear 33 for taking off the castings removed from the bottom die part.

Figure 4:
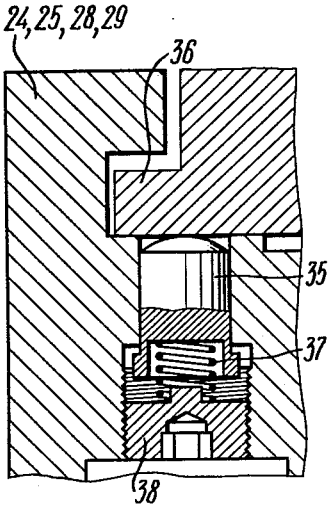
FIGS. 4 and 5 show a die registering gear in two extreme positions.
Figure 5:
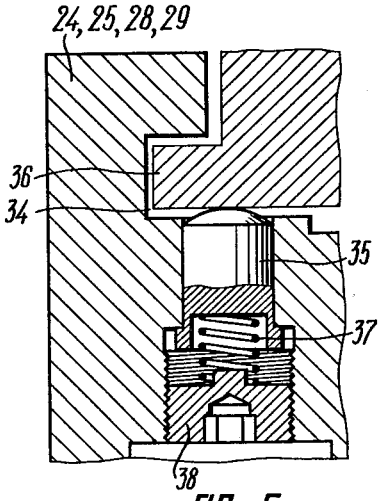

The devices 19 and **19*a* for the reiterated introduction and withdrawal of the die are arranged on the transporting device 3 and fitted with a gear for registering the die. Each of said gears has stops 35 disposed in grooves 34 (FIGS. 4 and 5) of the die plates 24, 25, 28 and 29 and fitted with projections 36 entering directly said grooves 34. The end faces of the stops 35 interact with springs 37 whose release effort is adjusted by screws 38**.

A bottom die part 39 (FIGS. 6 and 7), comprising a pusher plate 40 and a guide plate 41, is disposed on the base plate 32 of the machine, being centered on a projection 42. The base plate 32 has openings in which enter finger-members 43 to remove the castings. Said finger-members 43 are fixed on a movable crossbar 44 travelling along guide spindles 45 interconnecting the machine base plate and a plate 46 on which is fixed a hydraulic ram 47 adapted for carrying the crossbar 44. Fixed on the pusher plate 40 are brackets 48 with rollers 49 interacting with tracers of die gripping gear levers 50 articulated on the machine base plate. To enable sequential operation of the die gripping gear and of the device for removing the castings from one drive, the hydraulic ram 47 is made as a tandem-cylinder, comprising an autonomous piston 51 with a fixed stroke whose detent 52 interacts with a piston 53 connected by a rod 54 to the movable crossbar 44.

A gear for removing castings 55 from the bottom die part 39 (FIGS. 8 and 9) comprises hollow pushers 56 arranged in sleeves 57 of the bottom die part and interacting through the plate 40 with the casting. The pushers 56 are fitted with through holes common with their interior. Mounted in said holes are balls 58 and for precluding their dropping out of said holes, the latter are made tapering towards the pushing end. Set up on the plate 46 of the base plate 32 on disc springs 59 are the pushers of the base plate 32, said pushers being made as the finger-members 43 passing through the openings in the base plate 32 and made up each of a base 60 and a bush 61. Contained inside the sleeves 57 of the pushers 56 are pins 62 with end face collars 63 and a lead-in chamfer. The pins 62 are urged to the bush 61 by a nut 64 whose spherical surface interacts with a tapered washer 65. Said pins are arranged on coil springs 66.

The pusher bases 60 are fixed on the plate 46 through the disc springs 59 by means of nuts 67.

Figure 10:
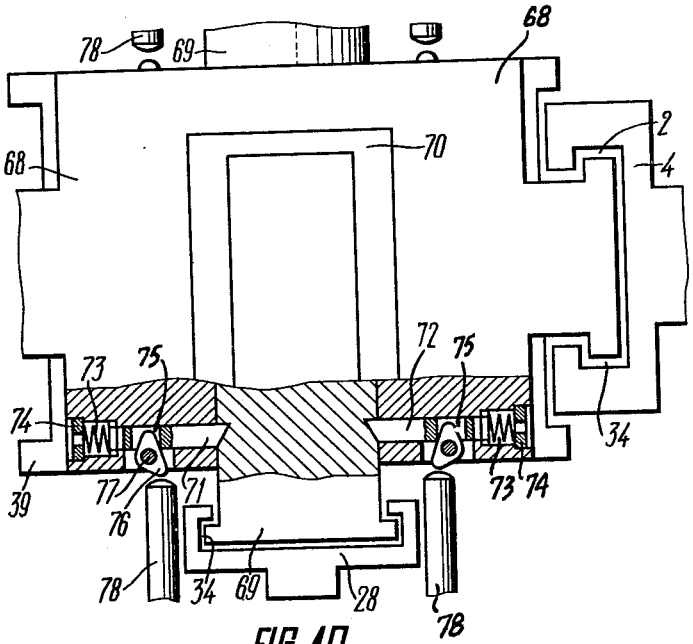
FIG. 10 depicts movable rods of a die plate and a gear for fastening the die parts.

The die-casting machine 2 is equipped with gears for fastening all die parts upon their assembly. Said die consists of side parts 68 (FIG. 10), end face parts 69, a top part 70 and the bottom die part 39. The gears for fastening the die parts include locating pins 71 and 72 with beveled ends, said locating pins 71 and 72 being spring-biased by springs 73 held in their seats by nuts 74. Grooves 75 of the locating pins 71 and 72 receive the ends of double-arm levers 76 articulated on spindles 77. The other ends of said levers 76 extend beyond the die periphery interacting with movable-axially rods 78 of the die-casting machine.

Figure 11:
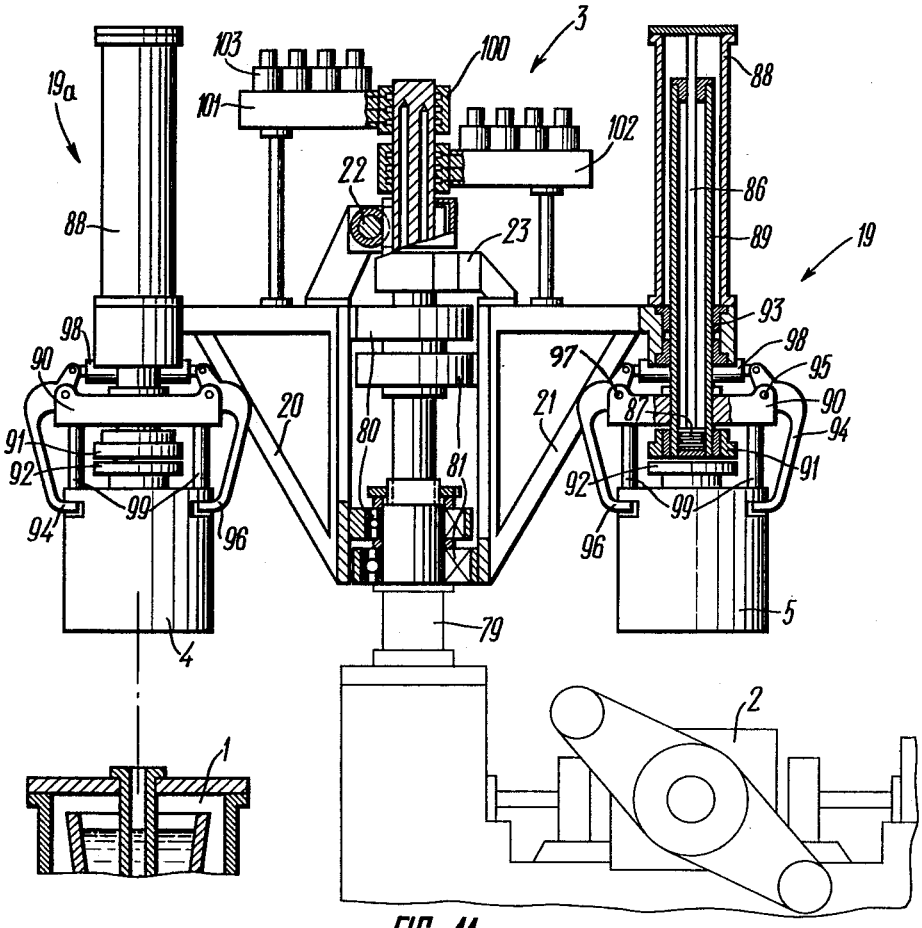
FIGS. 11, 12 and 13 show the device for reiterated introduction and withdrawal of the dies of a die-casting machine and a drive of a transporting device mounting said first device.

The brackets 20 and 21 of the transporting device 3 (FIG. 11) are arranged on a common column 79 by means of appropriate bearings 80 and 81.

Figure 12:
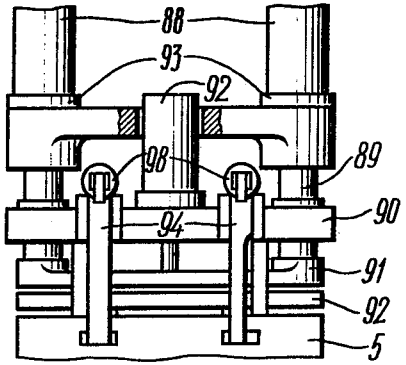

The drives 22 and 23 are disposed accordingly on the top bases of the brackets 20 and 21. Each of said drives is a toothed rack 82 (FIG. 12) fixed on the corresponding bracket 20 or 21 and interacting with a gear 83 fixed rigidly on the column 79. The rack 82 reciprocates under the effect of piston 84 of hydraulic rams 85. Said motion of the rack 82 is required to turn the brackets in opposite directions.

Figure 13:
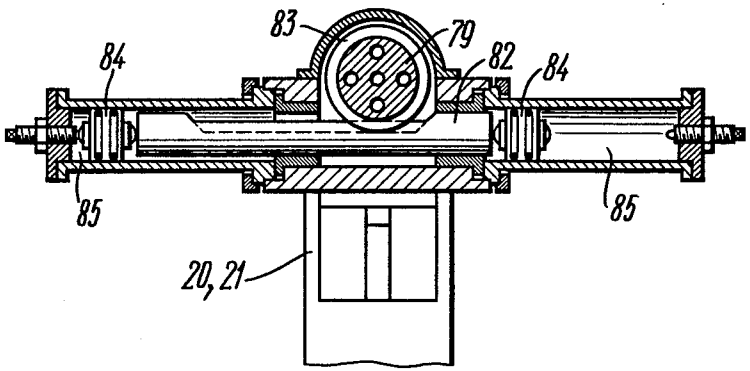

The devices 19 and 19*a* are cantilevered accordingly on each of said brackets. Each of said devices 19 and 19*a* has two power cylinders whose rods 86 with pistons 87 (FIGS. 11, 13) are cantilevered with the help of a tubular member 88 on the corresponding brackets 20 and 21. Power cylinder liners 89 are mounted movably in a vertical plane and carry a common power plate 90. Said plate mounts a gear for removing the castings from the top die part, said gear comprising a pusher crossbar 91 urged by a hydraulic ram 92 to move along the liners 89 functioning as guides of said crossbar 91. The removal of the casting from the top part of the die 4 or 5 is effected with the aid of the crossbar 91 acting upon the plate 90.

When introducing the die into and withdrawing it from the machine the liners 89 move in guides 93 fixed in the brackets 20 and 21.

Set up on the power plate 90 is a gear for gripping and keeping the die 4 and 5 on the transporting device 3. Said gear comprises four double-arm levers, of which two levers 94 are articulated on a spindle 95, while other two levers 96 are articulated on a spindle 97, said spindles 95 and 97 being mounted on the power plate 90.

One arm of each lever 94 and 96 interact with the die 4 or 5, while the other arm of said levers is associated with the rods of hydraulic rams 98.

In this case the power plate 90 carries lock rods 99 fixed thereon and interacting with the gripped die when the castings are removed from the top die part. All the hydraulic rams of the brackets 22, 23 are fed from a hydraulic system through the column 79, hydraulic manifolds 100 and corresponding hydraulic panels 101 and 102 with slide valves 103.

Figure 14:
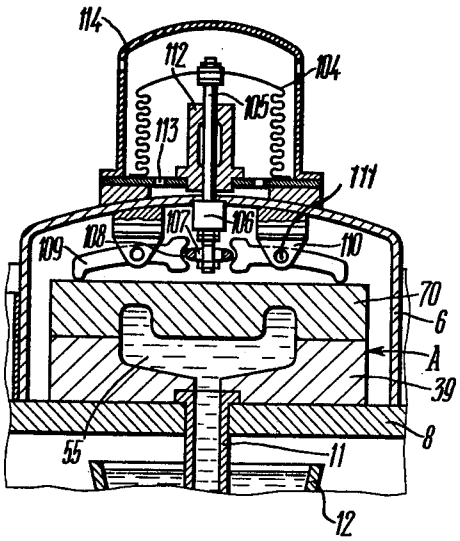
FIG. 14 is a longitudinal sectional view of a pouring device.

The gear 10 adapted for locking the die on the pouring device 1 (FIG. 14) comprises a bellows 104 with a rod 105 provided with a collar 106 and connected to a bellows bottom, an end 107 of the rod 105 carrying a shaped washer 108 that is brought into engagement with levers 109. Said levers are articulated with the help of brackets 110 and shafts 111 on the body 6 of the top sealed chamber. The opposite ends of the levers 109 interact with the top part 70 of the die and the rod 105 is arranged in a stationary sleeve 112 against which strike the collar 106. The internal space of the bellows 104 communicates with the cavity of the body 5 through holes 113.

To protect the bellows 104 against mechanical damage in the course of operation provision is made for a protective hood 114.

The partition plate 8 is made rotatable in a vertical plane about a spindle 115; to this end the pouring device is fitted with a rotary gear, comprising a hydraulic ram 116 fixed on the body 7 and a leverage 117 associated with the body 6. A flange 118 of the body 7 has an annular projection and an internal water-cooled cavity. The partition plate 8 is also provided with an annular projection and a water-cooled cavity; it has also a packing ring set up in a groove. A flange 119 of the body 6 is also fitted with a packing ring and a water-cooled cavity as well. The body 6 is sealed with the aid of the locking gears, comprising hydraulic rams 120 set up on the body 7; and a leverage 121. The partition plate 8 is protected against heat radiation from the body 7 with the help of a shield 122 and has an internal annular cavity 123 for supplying a coolant. To enable the partition plate to turn jointly with the body 6, it mounts joint pins 124 which, rotating about their axes and entering the corresponding slots in the flanges of the body 6 or 7 connect alternatingly and rigidly the partition plate to each of said bodies. The body 7 accommodates an electric furnace 125.

The proposed arrangement operates in the following manner.

Figure 2:
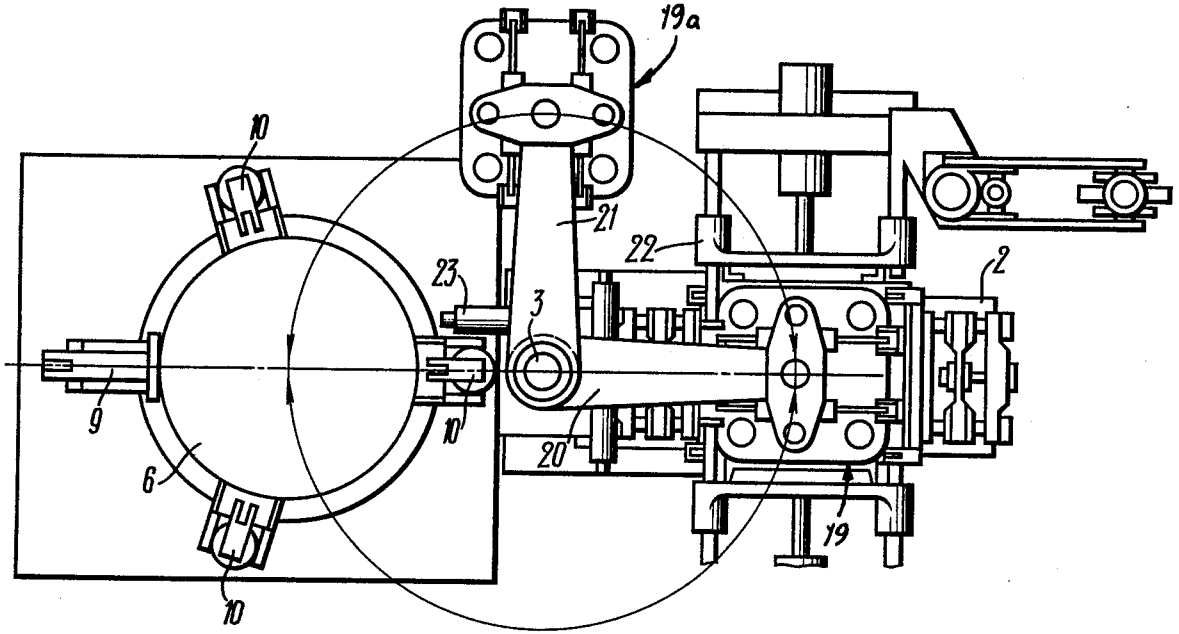
Figure 7:
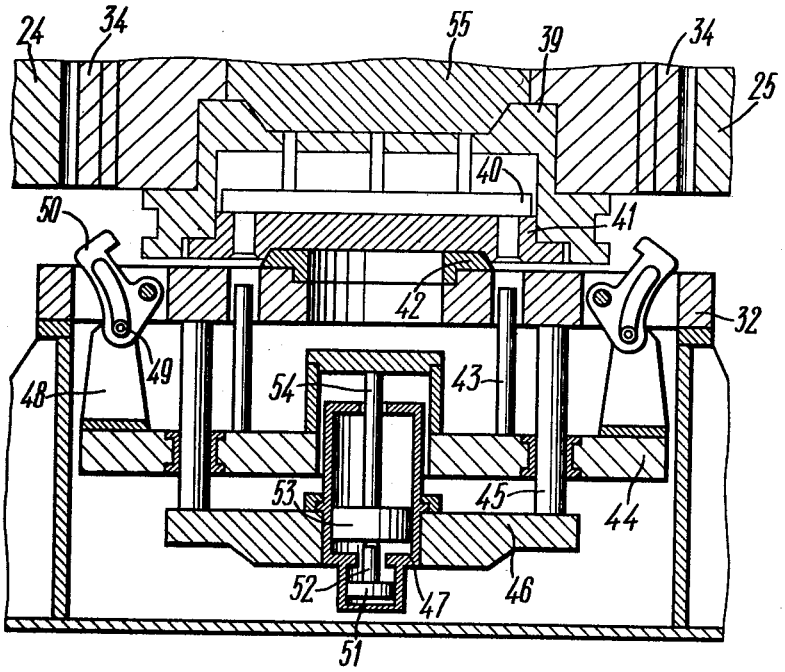

In the initial position the major working members of the arrangement occupy the positions represented in FIGS. 1 and 2, the bracket 20 of the transporting device 2 being arranged above the die-casting machine 2. The power plate 90 of the device 19 for reiterated introduction and withdrawal of the die 4 is in its top position, while the levers 94 and 96 keep the die with the solidified casting above the die-casting machine 2. The gears of said die-casting machine occupy the positions, shown in FIG. 3, the bottom die plates 24 through 29 are brought together, the levers 50 of the gear for gripping the die on the base plate 32 are separated, as shown in FIG. 7, and the gears 33 for taking off the castings are set to a position, given in FIG. 1, the gear for ejecting the castings from the bottom die part being set to a position, shown in FIG. 8.

The bracket 21 is in its intermediate position between the die-casting machine and the pouring device, the power plate 90 of said bracket being set to its top position and the levers 94 and 96 being brought apart. The die 5 is set up on the partition plate 8 so that its runner communicates through the pipe 11 with the vessel 12 filled with the melt 13, and the body 6 of the top chamber of the pouring device 1 is open. Next under the effect of the leverage 117 the hydraulic ram 116 turns the body 6 through 90°, whereupon said body 6 is locked by the hydraulic rams 120 and the other leverage 121. By virtue of the packing rings of the flange 119 and the projection on the partition plate 8 the body 6 is sealed, and by virtue of the packing ring of the plate 8 and the projection on the flange 118 of said body 7, the latter is sealed as well.

The compressor plant or the shop network supplies compressed gas through the pneumatic system comprising the valves 14, 15 and 16, as a result the same pressure is built-up in the bottom and top chambers accommodating the die 5, said pressure varying, e.g., when casting aluminum alloys from 6 to 10 kgf/cm$^2$. By bleeding the gas from the top chamber through the valve 17 or by building-up the pressure in the bottom chamber a pressure difference is created that is equal, e.g., while casting aluminum alloys to about 0.2–1.0 kgf/cm$^2$, said pressure difference being developed according to a given program, through which the die 5 is filled with liquid alloy at a preset variable speed.

Figure 15:
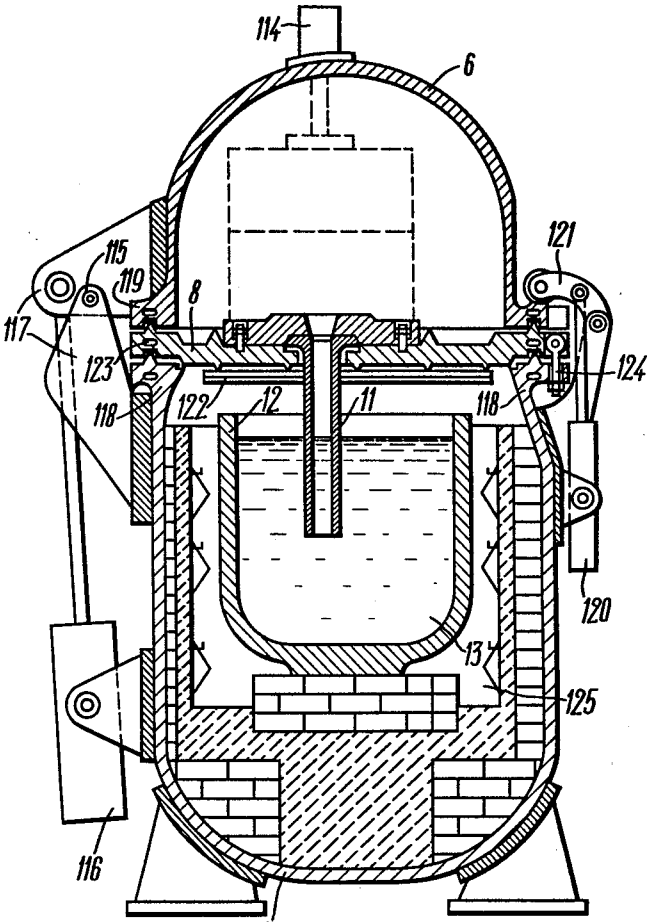
FIG. 15 shows a gear for locking the die parts on a partition plate of the pouring device.

When building-up a gas pressure under the body 6 the compressed gas passes through the holes 113 into the internal space of the bellows 104 which under the effect of said gas pressure expands and moves the rod 105 upwards. In this case the end 107 of said rod 105 carries the shaped washer 108 upwards, the washer 108 turning the levers 109 about the shafts 111 of the brackets 112. The bottom ends of the levers 109 acting on the top part 70 of the die 5 urge said die part to the bottom part 39 locking thus said parts, as shown in FIG. 15. In case the die is composed of more than two parts (side, end face, etc.) the body 6 should mount several locking gears, similar in design and operating in a similar manner to the above-outlined locking gear.

After a technological holding that is required for the casting to solidify the gas pressure in the cavities of the bottom and top chambers accommodating the die 5 becomes equal, whereupon it is simultaneously decreased by opening the valves 17 and 18. At a drop in pressure of the compressed gas under the body 6 said gas escapes from the interior of the bellows 104, relieving thereby the extension forces of said bellows 104, and under the effect of resilient forces of the bellows material the rod 105 drops down and turns through the washer 108 the levers 109 about the shafts 111 of the brackets 110 to their initial position, releasing therefore the top die part 70 and, hence, unlocking the casting die 5.

To preclude excessive extension of the bellows 104 during idle trials of the pouring device without the die (which must be arranged on the plate 8) the rod 105 is fitted with a collar 106 which strikes against the sleeve 112 limiting the stroke of the rod 105 and, hence, protecting the bellows 104 against excessive extension which may cause its damage. Upon calcelling the gas pressure the body 6 is unlocked and opens with the help of the leverages 117 and 121 turning it through 90° C. In this case the partition plate 8 is held on the flange 118 of the body 7 of the bottom chamber by means of the joint pins 124. The die 4 with the solidified casting is removed from the partition plate and carried to the die-casting machine.

If it is necessary to examine the vessel 12 or to add the melt therein, to inspect and paint the pipe 11, the casting die is removed from the partition plate, the body 6 is closed, whereupon the partition plate 8 is fastened to the flange 119 of the body 6 by the joint pins 124. Next by using the leverage 117 the hydraulic ram 116 turns the body 6 together with the partition plate 8 fixed thereon through 90°. In this case the pipe 11 rotating together with the partition plate 8 comes out of the vessel 12 and is set to a horizontal position which is convenient for both the examining and painting of said pipe. The melt is added, is required, into the vessel 12 of the open bottom chamber and the latter is examined and cleaned. Following that the body 6 together with the plate 8 and pipe 11 are rotated by the hydraulic ram 116 and the leverage 117 in opposite directions, the plate 8 being set up on the flange 118 of the body 7, whereupon the body 7 is fastened by means of the joint pins 124 to the partition plate 8 and the body 6 is open again. The pouring device returns to its initial position.

On completion of the above operations of the pouring device, upon pouring the die 5 and after the casting 55 has solidified, therein, the drive 23 rotates the bracket 21 through 90°, the bracket being thus arranged above the pouring device. Next the liners 89 of the cylinders 92 lower the power plate 90 and the lock rods 99 come in contact with the top part 70 of the die 5. Following that the levers 94 and 96 grip the die 5 by means of the hydraulic rams 98. Next the hydraulic rams 92 with the liners 89 severe and lift the die 5 with the casting 55 from the plate 8 of the pouring device. On completion of the die lifting operation the drive 23 turns the bracket 21 and sets it to its intermediate position.

Figure 8:
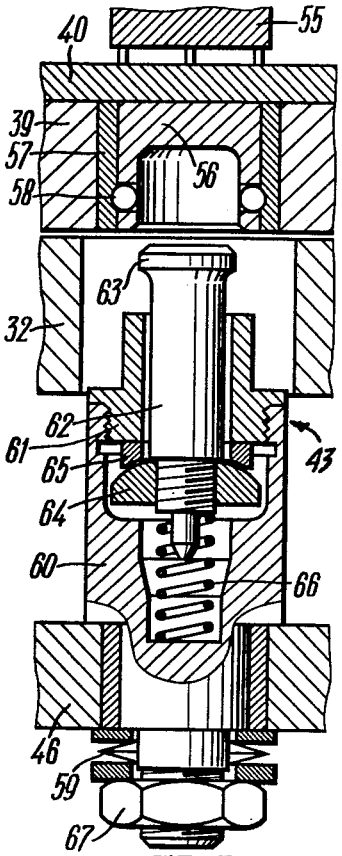
FIGS. 8 and 9 show a gear for the removal of castings from the bottom die part in two extreme positions.

Simultaneously when closing the body 6 for pouring the die 5 the bracket 20 of the device 19 for the reiterated introduction and withdrawal of the die under the effect of the liner 89 of the hydraulic rams 92 lowers the power plate 90 with the die 4. As a result, the stops 35 of its side parts 68 and end face parts 69 are free to enter the grooves 34 of the side die plates 24 and 25, the end face die plates 28 and 29 of the machine coming in contact with the rounded-off ends of the spring-biased projections 36, the guide plate 41 of the bottom part of the die 4 being centered on the projection 42 of the machine base plate 32 so that the holes in the die pushers 56 are axially aligned with the pins 62. In this case the movable base plate crossbar 44 of the die-casting machine is in its bottom position, the pins 62 with the collars 63 being lowered bellow the top plane of the base plate 32, as shown in FIG. 8.

Upon mounting the die 4 on the machine base plate in compliance with the operating graph of the proposed arrangement a command is sent to lift the autonomous piston 51. Under the effect of the working fluid fed beneath the piston 51 (the rod and interpiston spaces being in this case in communication with the drain), the latter moves by a definite value and acting on the piston 53 with the help of the detent 52 raises the crossbar 44 which in turn acts with the help of the rollers 49 fixed in the brackets 48 on the levers 50 and turns them. Upon rotating the lever 50 and gripping th bottom part 39 of the die 4, the latter is disassembled.

The disassembly of the die 4 is initiated by moving the end face die plates 28 and 29 of the machine. In this case at the beginning of the stripping operation the rods 78 with the aid of the severing cylinders arranged in the guide spindles of the end face die plates 28 and 29 during the forward stroke act on the ends of the levers 76 projecting from the grooves of the locating pins 71 and 72 beyond the periphery of the die, and by compressing the springs 73 bring the pins 71 and 72 out of the registering seats of said end face die parts 69 releasing them thereby. Next during the further forward stroke the rods 78, bouncing off the side parts 68 of the die, sever the end face die parts 69 for a required extent, whereupon the drives 30 and 31 bring the end face die parts 69 apart to a requisite distance. Following that the drives 26 and 27 carry the side die plates 24 and 25 with the side parts of the die 4 keeping the casting on the bottom part 39 of the die with the help of the side pushers. After that the top part of the die is lifted with the aid of the hydraulic ram 85, this being followed by severing and removing of the casting from the bottom part of the die 4.

Figure 6:
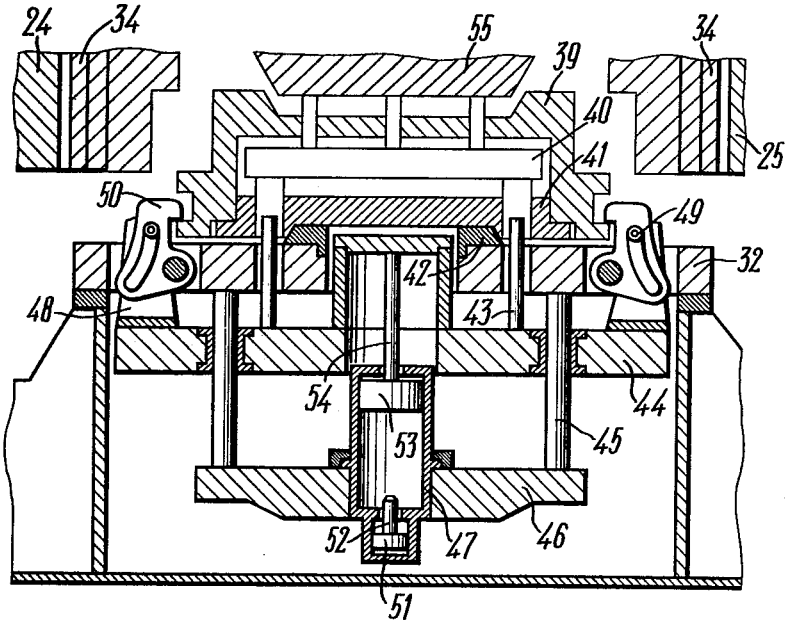
FIGS. 6 and 7 represent a longitudinal cross-sectional view of a gear for gripping the die on a base plate of a die-casting machine, said gear being shown in two extreme positions.
Figure 9:
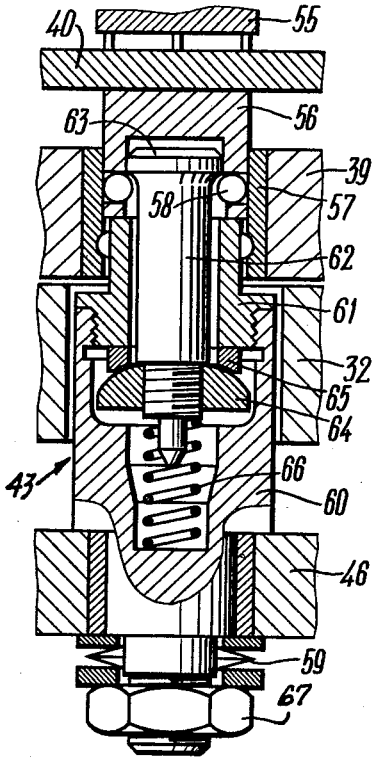

Upon receiving the command to remove the casting, the crossbar 44 rises with the aid of the piston 53 and rod 54 along the guide spindles 45, and the pins 62 centered by the spring 66 are free to enter into the pushers 56 of the bottom die part but not reaching the end faces of said pushers. During further upward motion of the crossbar 44 the bases 60 enter the holes in the base plate 32 and the top end face of the bushes 61, acting upon the bottom end faces of the pushers 56 and carrying the latter upwards. In this case the balls 58 which are carried together with the pushers 56 roll over the interior of the sleeves 57 leaving the seats of said sleeves and entering the interiors of the pusher seats, as shown in FIG. 9. The rollers 49 rolling over the tracers of the levers 50 keep said levers in place, as shown in FIG. 6. The piston 53 is lifted by the pressure of the working fluid which is fed in the interpiston space of the hydraulic ram 47 (the rod space of the ram 47 and that under the piston 51 being in this case connected to the drain). Then the piston 51 with the detent 52 returns to its initial position, as shown in FIG. 6.

Upon carrying the pushers 56 for a given distance and removing the castings 55 with the aid of the pusher plate 40 of the bottom part 39 of the die 4, the finger-members 43 are returned to their initial position. To this end the crossbar 44 is moved downwards with the help of the piston 53 and rod 54, the bottom end faces of the collars 63 of the pins 62 interacting with the balls 58 found in the pushers 56 and carrying said pushers 56 downwards. When the balls 58 reach the openings in the sleeves 57, they enter said openings releasing thereby the pins 62 with the pushers 56 which are returned to their initial position in the bottom part 39 of the die 4. During further downward travel of the crossbar 44 the bushes 61, bases 60 and pins 62 are placed in their initial position as shown in FIG. 8. To provide synchronous motion of all the finger-members 43 fixed in the crossbar 44 and a possibility of adjusting the initial position of the end faces of said bushes 61, the bases 60 of the finger-members 43 are secured in the crossbar 44 on the disc springs 59 compressed by the adjusting nuts 67. The piston 53 moves to the initial bottom position under the pressure of the working fluid being built-up in the rod space of the hydraulic ram 47 with the other spaces of said ram being connected to the drain. In this case the crossbar 44, on being carried to its bottom position, acts with the rollers 49 set up in the brackets 48 on the tracers of the levers 50 and at the end of the stroke the rollers 49 turn said levers releasing the bottom die part 39 and carrying the base plate of the die-casting machine to its initial position, as shown in FIG. 7.

After the removal of the casting from the bottom die part, its cleaning, blowing and whitening of the working die surfaces, the die is assembled.

The side parts 68 of the die are assembled on its bottom part 39 fixed on the projection 42. To this end the side die plates 24 and 25 are carried with the side parts 68 of the die by the drives 26 and 27. To preclude the transmission of the tilting forces to the bottom die part 39 the side die plates 24 and 25 are fitted with the devices limiting the plate motion during assembly, while the side parts 62 of the die are provided with guide pins. Next the top die part 70 is lowered with the help of the device for introduction and withdrawal of the die, the end face die plates 28 and 29 of the machine closing with the end face die parts 69 mounted thereon.

In this case the end face die parts acting on the chamfers of the locating pins 71 and 72 move them, compressing the springs 73. At the end of said motion of the end face die parts 69 the pins 72 enter under the effect of the springs 73 the registering seats in the side die parts 68 and fasten the side and end face die parts together. During that operation the rods 78 are withdrawn and do not act on the levers 76. The lower and top die parts are fastened to its side parts in a similar manner. As a result of the above operations, the die parts are assembled and fixed into a single die.

On completion of the assembly and fastening of the die parts the stops 35 under the effect of the springs 37 overcome the friction force and urge the die plates 24, 25, 28 and 29 to move from the corresponding die parts for a definite value, providing all-round clearance A between the grooves 34 of the die plates and projections 36 of the die parts. The assembled die 4 released from the said plates and from the base plate of the die-casting machine is lifted with the aid of the device 19 and is turned on the bracket 20 in a horizontal plane by the transporting device 3 through 180° being thus arranged on the other side of the bracket 21. As a result, the die 4 is disposed above the pouring device. Next the die is lowered on the partition plate 8 of the pouring device so that the runner opening is in register with that of the pipe 11. The levers 94 are brought out of engagement with the die and the power plate 90 rises to the opposite position. Simultaneously with the rotation of the bracket 20 with the assembled die 4 the bracket 21 and die 5 accommodating the solidified casting rotates from its intermediate position through 90° and stops above the die-casting machine 2.

The first half of the arrangement operating cycle is completed. The second half-cycle is effected in a similar manner, the only difference residing in that the device 19 for the introduction and withdrawal of the die operates with the die 4 mounted on the pouring device, while the similar device 19*a* operates with the die 5 set up on the die-casting machine. On completion of the entire cycle the arrangement returns to the initial position.

The above-described operating cycle of the proposed arrangement is reiterated.

If during the technological cycle of disassembling the die on the die-casting machine the casting remains in the top die part 70, the latter together with the casting is lifted upon stripping the end face and side die parts of the die-casting machine, said operation being effected by the devices 19 and 19*a*. Upon setting the bracket of the transporting device 3 to its intermediate position the casting is removed from the top die part to the receiving pan. To this end the pusher crossbar 91 is lowered by means of the hydraulic ram 92 fixed on the power plate 90, said crossbar 91 acting upon the plate 90 of the top die part 70 and pushing-out the casting. During the transfer of the pusher crossbar 91 the liners 89 function as guides and the levers 94 and 96 acting through the top die part 70 on the lock rods 99 hold the top die part 70 and limit the casting removing force to the power plate 90, relieving the brackets of the transporting device and the column 79 from said forces. Upon removing the casting from the top die part 70 the power plate 90 is raised, the rotary gears turning again the bracket of the transporting device and setting it to a position above the die-casting machine. Next the power plate 90 descends and the die-casting machine assembles the die parts. As to the operation of the other gears of the proposed arrangement in the course of the technological cycle, it is effected similarly to the above outlined.

The herein-proposed arrangement enables the production of both simple and intricate sound castings by using casting dies with various parting lines, such as:

dies with a single horizontal parting line;
those with a single vertical parting line;
those with two parting lines: a horizontal and a top vertical ones;
dies with two parting lines: a horizontal and a bottom vertical ones;
dies with three parting lines: a vertical one, a top and a bottom horizontal ones.

Use can be made of the dies provided with additional end face joints.

The arrangement is adaptable for producing castings in dies whose bottom half is fixed on the partition plate 8. In this case the casting is removed from the top half of the die either upon raising the power plate with the top half of the die to the pouring position or upon turning the bracket to its intermediate position.

The transporting devices may have another embodiment with the arrangement operating simultaneously with more than two dies.

When the proposed arrangement is used for low-pressure die casting, its operation differs only in that for pouring the die through the open valves 14 and 15 an excess gas pressure is created in the cavity of the bottom chamber of the pouring device, the body 6 being at this time open and the die being under atmospheric pressure.

The proposed arrangement can operate at a setting-up, semi-automatic and automatic duties.

We claim:

1. A counterpressure casting arrangement, comprising: a pouring device; a partition plate dividing said pouring device into a top chamber and a bottom chamber, a body of said top chamber and said partition plate being turnably mounted with respect to a body of said bottom chamber; a vessel for melt accommodated in said bottom chamber; a split casting die accommodated in said top chamber; a pipe interconnecting said vessel and said split casting die; a die-casting machine disposed outside the body of said top chamber and acting as a device for assembly and disassembly of the die and for removing castings from said die; a device for reiterated introduction and withdrawal of the dies arranged in said die-casting machine; a transporting device, on which said device for reiterated introudction and withdrawal of the die is mounted, to carry the dies from said die-casting machine to said partition plate and back to the machine; a stationary spindle about which the body of said top chamber turns to permit movement of said transporting device.

2. An arrangement according to claim 1, wherein the device for reiterated introduction and withdrawal of the die of said die-casting machine is fitted with a gear for registering the die, said gears for registering having spring-biased stops arranged in grooves of die plates of said die-casting machine, said stops being made so as to interact with the die parts, and with a gear for gripping the die on a base plate of said die-casting machine, said base plate being furnished with a movable crossbar, said gripping gear having driven articulated levers with tracer grooves accommodating rollers mounted in brackets of said crossbar, said levers being made to interact with the bottom die part.

3. An arrangement according to claim 2, wherein the base plate of the die-casting machine is provided with a gear for removing castings from the bottom die part, said gear for removing having bushes arranged on the movable crossbar, bush bases accommodating collar-ended pins mounted on resilient members, said bushes and pins being made so that, when removing the castings, the bushes can interact with pushers of the bottom die part, said pushers being made hollow and the pins being free to enter said pushers, as the pushers of the bottom die part return to their position the collars on the pin end faces being able to interact with balls mounted in said pushers and running therein.

4. An arrangement according to claim 2, wherein the gears for gripping the die on the base plate of the die-casting machine and for removing the castings from the bottom die part have a common drive, which is a power cylinder set up on the base plate and comprising two movable members, one of which is autonomous and is mounted for interacting, in the course of gripping, with the die on the base plate, the other movable member being linked mechanically with the movable crossbar.

5. An arrangement according to claim 2, wherein the die plates of the die-casting machine are provided with axially movable rods, each rod being capable of interacting with the die parts and being fitted with gears for fastening said parts into a single die, each of said bears being made as spring-biased and axially movable grooved pins and double-arm articulated levers, one arm of each of said levers being accommodated in the groove of the corresponding pin and being able to interact with said pin, and the other arm interact with the rods.

6. An arrangement according to claim 1, wherein the transporting device includes brackets turnably mounted on a common column, each of said brackets being provided with an individual rotary drive arranged on a top base of each bracket, the device for reiterated introduction and withdrawal of the die of said die-casting machine being cantilevered on each of said brackets.

7. An arrangement according to claim 6, wherein each of the individual rotary drives includes a toothed rack fixed on the appropriate bracket and interacting with a gear disposed on the common column, said racks being made to reciprocate for turning the brackets in opposite directions.

8. An arrangement according to claim 1, wherein the device for reiterated introduction and withdrawal of the die includes power cylinders, whose rods with pistons are cantilevered on the appropriate bracket, and cylinder liners, which are movably set in a vertical plane and carry a power plate and a gear for removing the castings from the top die part with a pusher crossbar, said power plate being fitted with a gear for gripping and keeping the die on the transporting device, the bracket has guides for the liner whose bottom end acts as a guide for the pushers of the crossbar.

9. An arrangement according to claim 8, wherein the gear for gripping and keeping the die on the transporting device includes four driven double-arm levers, one arm of each lever being able to interact wiht the die, the power plate carrying lock rods fixed thereon and interacting with the gripped die as the casting is being removed from the top die part.

10. An arrangement according to claim 1, wherein the body of the top chamber of the pouring device is fitted with a gear for locking the die parts on the partition plate which includes double-arm driven levers, one of the arms of each lever interacting with the die, a lever drive including a bellows with a rod, the bellows space communicating with the top chamber and the bellows rod being fitted with a limiting collar and interacting with the other arm of each of said levers.

11. An arrangement according to claim 10, wherein the partition plate is mounted on the stationary spindle, is in alignment with a pivotal axis of the body of the top chamber and can turn about said spindle in a vertical plane, said plate being provided with a gear for connecting it alternatingly to the bodies of the top and bottom chambers.

* * * * *